US010932558B2

(12) United States Patent
Magni et al.

(10) Patent No.: US 10,932,558 B2
(45) Date of Patent: Mar. 2, 2021

(54) DEVICE FOR PRODUCING ROUND BRUSHES

(71) Applicant: BORGHI S.p.A., Castelfranco Emilia (IT)

(72) Inventors: Ettore Magni, Castelfranco Emilia (IT); Enzo Ferrari, Castelfranco Emilia (IT)

(73) Assignee: BORGHI S.P.A.

( * ) Notice: Subject to any disclaimer, the term of this patent is extended or adjusted under 35 U.S.C. 154(b) by 136 days.

(21) Appl. No.: 16/096,831

(22) PCT Filed: Apr. 19, 2017

(86) PCT No.: PCT/EP2017/059268
§ 371 (c)(1),
(2) Date: Oct. 26, 2018

(87) PCT Pub. No.: WO2017/186539
PCT Pub. Date: Nov. 2, 2017

(65) Prior Publication Data

US 2019/0125069 A1 May 2, 2019

(30) Foreign Application Priority Data

Apr. 27, 2016 (DE) ..... 10 2016 107 839.5

(51) Int. Cl.
*A46D 3/05* (2006.01)
*A46D 9/02* (2006.01)
(Continued)

(52) U.S. Cl.
CPC ..... *A46D 3/05* (2013.01); *A46B 3/08* (2013.01); *A46B 3/18* (2013.01); *A46B 9/026* (2013.01); *A46D 3/08* (2013.01); *A46D 9/02* (2013.01)

(58) Field of Classification Search
CPC ... A46D 3/05; A46D 3/08; A46D 9/02; A46D 1/08; A46D 1/04; A46D 9/00; A46D 3/04; A46D 3/00; A46B 3/08; A46B 3/18; A46B 9/026; B21F 45/00; B21F 7/00; A47G 33/06
See application file for complete search history.

(56) References Cited

U.S. PATENT DOCUMENTS 3,254,923 A * 6/1966 Marks ..... A46D 3/05 300/21
8,020,942 B2 9/2011 Manici et al.
(Continued)

FOREIGN PATENT DOCUMENTS

CN 101099616 A 1/2008
CN 102687950 A 9/2012
(Continued)

OTHER PUBLICATIONS

PCT International Search Report and Written Opinion dated Jul. 13, 2017 from corresponding Application No. PCT/EP2017/-50279, 12 pages.

*Primary Examiner* — Robert J Scruggs
(74) *Attorney, Agent, or Firm* — Dilworth IP, LLC

(57) ABSTRACT

An apparatus for manufacturing round brushes includes motor-driven driven rollers (22, 26) which on twisting of the wire halves urge wire to a rotating gripper (60). The wire material slides along diverters (52, 54).

14 Claims, 4 Drawing Sheets

(51) Int. Cl.

| | |
|---|---|
| ***A46B 3/08*** | (2006.01) |
| ***A46B 3/18*** | (2006.01) |
| ***A46B 9/02*** | (2006.01) |
| ***A46D 3/08*** | (2006.01) |

(56) References Cited

U.S. PATENT DOCUMENTS

| | | | | |
|---|---|---|---|---|
| 8,915,551 | B2 * | 12/2014 | Rees | A46D 3/05 300/2 |
| 2005/0242655 | A1 * | 11/2005 | Romagnoli | A46D 3/082 300/2 |
| 2008/0023024 | A1 | 1/2008 | Manici et al. | |

FOREIGN PATENT DOCUMENTS

| | | | |
|---|---|---|---|
| DE | 102011015060 | A1 | 9/2012 |
| EP | 1917886 | A1 | 5/2008 |

* cited by examiner

DEVICE FOR PRODUCING ROUND BRUSHES

This invention relates to an apparatus for manufacturing round brushes.

Round brushes are manufactured in that a wire first is folded and then during a twisting process bristles are clamped between the twisting wire halves.

BACKGROUND OF THE INVENTION

Such apparatuses operate at extremely high speeds, and the wire must first be slightly kinked from a linear shape in the region of its middle, whereupon it can be grasped by a rotating gripper. The linear portions of the wire, which are not yet bent, are pulled into the twisting region via diverters, as the rotating gripper usually is also moved linearly, transversely to the longitudinal extension of the bent wire so that a wire feed must be effected.

It is the object of the invention to render the different functions that must be fulfilled in an apparatus for manufacturing round brushes as easily adjustable as possible and to accomplish an individual optimization of these different functions.

SUMMARY OF THE INVENTION

This object is solved by claim 1.

The longitudinal extension or longitudinal direction of the wire is the direction of the wire when the same is not yet kinked, but only fed into the apparatus. Here, the wire is linear.

The apparatus according to the invention has two opposed counter-brackets that are spaced apart from each other and that serve to receive the bending part between themselves when the wire is kinked for the first time or is to be slightly bent in its middle.

The preferred embodiment provides that in addition to the opposed counter-brackets diverters spaced apart from each other, for example in the form of chicanes, also are provided for the abutment of the wire. Along these diverters the wire halves are guided after the wire has been bent or folded in the middle. The diverters hence form a transition from the non-bent wire portions of the wire halves to the wire portions leading to the rotatable gripper transversely to the longitudinal direction. The wire rests against these diverters when it must change its direction, namely from the longitudinal direction to the direction towards the gripper extending transversely, almost at an angle of 90° thereto.

The counter-brackets and the diverters should be different parts and should be movable into contact with the wire one after the other. This is not the case in the prior art, as here counter-brackets and diverters always are the same parts, which are permanently in contact with the wire. Due to the fact however that counter-brackets and diverters are different parts according to the invention, they can individually be optimally adapted to their functions. The counter-brackets are perfectly adjusted to the bending part received between the same in order to perfectly shape and clamp the wire between the counter-brackets and the bending part. The diverters also can be optimized. The diverters namely serve to on the one hand divert the wire and on the other hand also provide a certain resistance to the wire, so that the wire piece is kept under tension between gripper and diverter when it is twisted. Separate braking devices therefore are not necessary in the apparatus.

The counter-brackets and/or the diverters are traversable such that they can be brought into contact and out of contact with the wire in order to form a bending surface for the wire, along which the wire is moved and bent.

The diverters just like the counter-brackets are adjustable in the longitudinal direction of the non-bent wire and/or transversely to the longitudinal direction. Thus, either the counter-brackets are shifted in order to come into contact with the wire, or the diverters. During the process, first the counter-brackets are shifted so that the bending part can press between the counter-brackets and bends or kinks the wire. Subsequently, however, the diverters are used when the counter-brackets have been moved away. Then, the wire kinked or bent in its middle is applied to the diverters or, vice versa, the diverters are moved against the wire so that the rotatable gripper then can further withdraw the wire and this wire presses against the diverters.

Preferably the wire always can remain in the same holder, which for example is defined by the drive rollers, while counter-brackets and diverters are shifted. This means that counter-brackets and diverters can have substantially the same operative position when the wire is in contact with the same. Counter-brackets and diverters only alternately are moved into this operative position.

The motor-driven drive rollers are arranged in the longitudinal direction of the wire outside the counter-brackets and diverters, i.e. they receive the same between themselves when they are in their operative position. This means that the drive rollers can press and transport wire material in the direction of the counter-brackets and the diverters.

Each drive roller can have a counter-roller and form a drive roller pair with the same, which transports the wire therebetween and clamps the wire for the transport as free from slip as possible.

Outside the region between the drive rollers a motor-driven auxiliary drive roller can be provided, which transports the wire from a supply to the drive rollers.

In addition, a wire cutting device preferably is provided between the auxiliary drive roller and the nearest drive roller in order cut off the wire piece that is being processed from the wire supply.

A simple design of the invention is achieved when the counter-brackets are protruding, juxtaposed portions of an integral bending jaw. The counter-brackets hence merge into each other so to speak at a connecting web.

The bending part should be adapted in its outer shape to the shape of the gap between the counter-brackets and be formed complementarily. Of course, a small gap must be left to receive the wire, so that the same is not squeezed unnecessarily.

The diverters according to the preferred embodiment of the invention are configured as chicanes with an arc-shaped bending surface for the wire. In particular, the bending surface should be configured as a sliding surface for the wire. Rollers are not necessary here and even disadvantageous.

A particular embodiment of the invention provides that the drive rollers are actuated such that during the twisting of the wire, in particular during the entire twisting process, they urge wire portions towards each other and in the direction of the gripper. This means that the propulsive force of the gripper preferably is not sufficient to advance the wire on twisting, i.e. to transport non-twisted portions of the ends of the wire halves. This is accomplished by the drive rollers, which in this state of the process also transport wire to the bending surfaces.

There can be provided a finishing station into which the twisted wire can be inserted and which further twists the wire and/or cuts the bristles on the outside.

A particularly effective apparatus is obtained when the finishing station has a stationary gripper that can grasp the free ends of the wire halves. The apparatus is rotatable or pivotable, e.g. it has a rotatable base to which a plurality of rotatable grippers are attached. By rotating, a rotatable gripper that has just been in use together with the wire just twisted, which it still grasps, is transferred from a feed station (i.e. the station with counter-bracket and drive rollers) into the finishing station. There, the wire just twisted is grasped by the stationary gripper, wherein for the further twisting the rotating gripper can be put into rotation. Alternatively, the stationary gripper can of course also be released, i.e. be put into movement along with the rotating gripper via the wire, so that on the outside a knife can be moved along the bristles in order to cut them off.

BRIEF DESCRIPTION OF THE DRAWINGS

Further features and advantages of the invention can be taken from the following description and from the following drawings to which reference is made.

In the drawings.

DETAILED DESCRIPTION OF THE INVENTION

Figure 1:
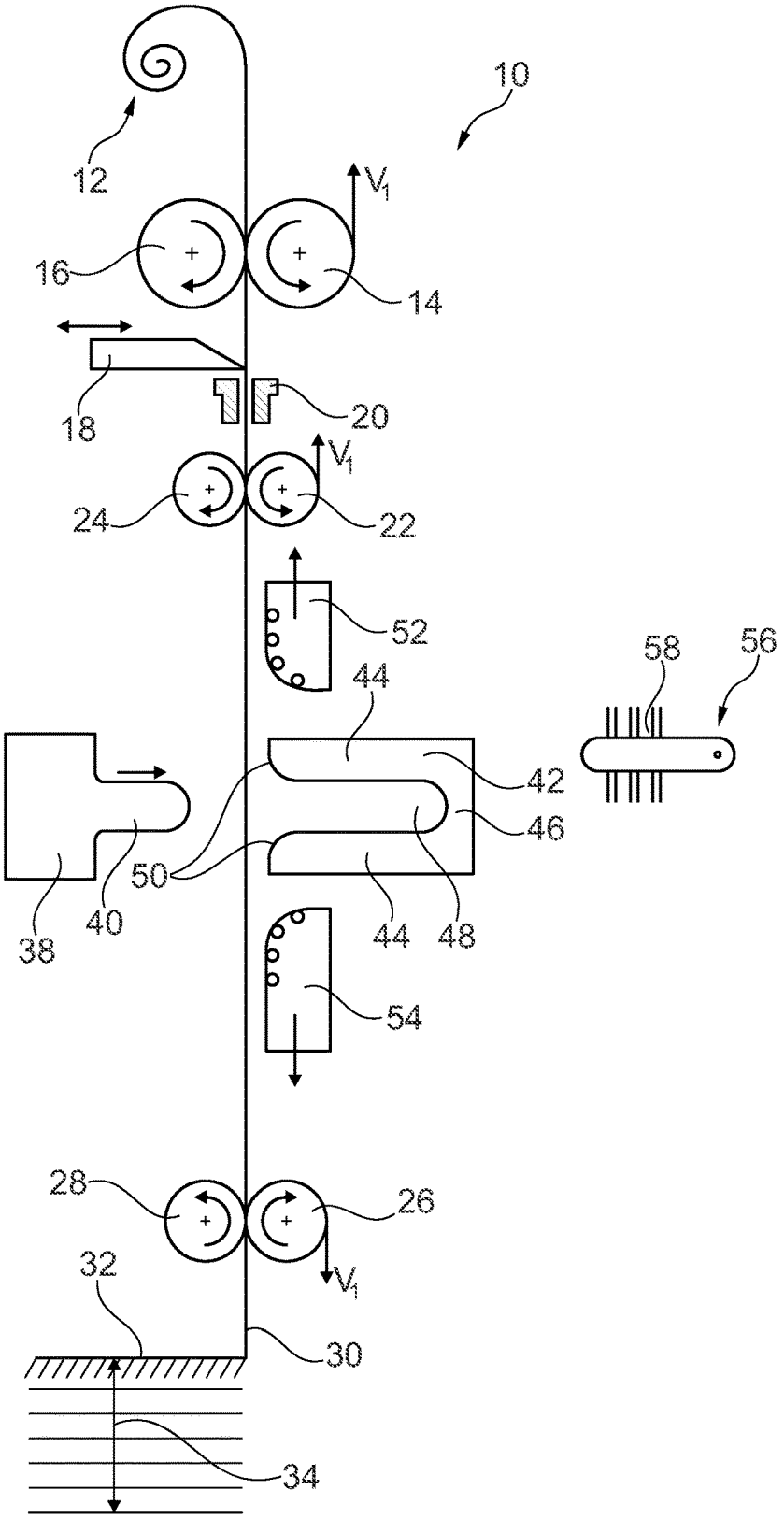
FIG. 1 shows a schematic view of an apparatus according to the invention for manufacturing round brushes.

FIG. 1 shows an apparatus 10 for manufacturing round brushes. For this purpose, a stylized supply 12 of wire is present, from which wire is withdrawn and transported into the apparatus. In the wire feed direction a motor-driven auxiliary drive roller 14 and a counter-roller 16 are provided, which form a pair of auxiliary drive rollers. Here, one or both of the rollers can be drivable. Between the rollers 14, 16 the wire is fed. After the pair of auxiliary drive rollers an adjustable knife 18 is present, which cuts off a sufficiently long piece of wire, as will yet be explained below.

A guide 20 serves to act as a counter-knife and at the same time guide the wire. After the guide 20 a first pair of drive rollers with a first motor-driven drive roller 22 and a counter-roller 24 is arranged, which receive the wire between themselves. A second pair of drive rollers distinctly spaced apart therefrom comprises a second motor-driven drive roller 26 as well as a counter-roller 28, which receive the free end of the wire 30 and for example move it up to a stop 32. As indicated with the arrows 34, the stop 32 is adjustable in order to be able to variably adjust the length of the wire piece between the knife 18 and the stop 32.

The wire 30 extends linearly between the first and the second pair of drive rollers and also up to the pair of auxiliary drive rollers, as is clearly shown in FIG. 1.

To bend the wire 30, the following devices are provided. A bending part 38 reciprocable transversely to the longitudinal direction of the wire or the longitudinal extension of the wire (linear extension in the unbent condition according to FIG. 1) has a trunnion 40.

This trunnion 40 faces the wire 30. On the side of the wire opposite to the trunnion 40, i.e. facing the trunnion, there is provided an integral bending jaw 42 that comprises two counter-brackets 44 spaced apart from each other, which are integrally connected to each other by a web 46 and form a gap 48 between themselves. The free ends of the counter-brackets each extend over an arc 50 that extends over substantially 90°, from the longitudinal direction of the wire 30 up to the gap 48, where the arc then substantially transitions into a portion that extends at 90° to the longitudinal direction of the wire 30.

In addition, there are provided two diverters 52, 54 that are adjustable in one or more directions and that likewise lie between the pairs of drive rollers. As will yet be explained below, these diverters 52, 54 are used when twisting the wire.

There is symbolically shown a bristle feeding device 56 that carries bristles 58, which one after the other are received and clamped between the wire halves that are formed.

Both the counter-brackets 42, i.e. the entire bending part 38, and the diverters 52, 54 are movable so that they get into action one after the other and are acted upon by the wire 30 one after the other in order to control its bend.

In FIG. 1, the motorically traversable diverters 52, 4 are out of engagement with the wire and not in operation. The counter-brackets 44 however are in operation, as will be explained in FIG. 2.

Figure 2:
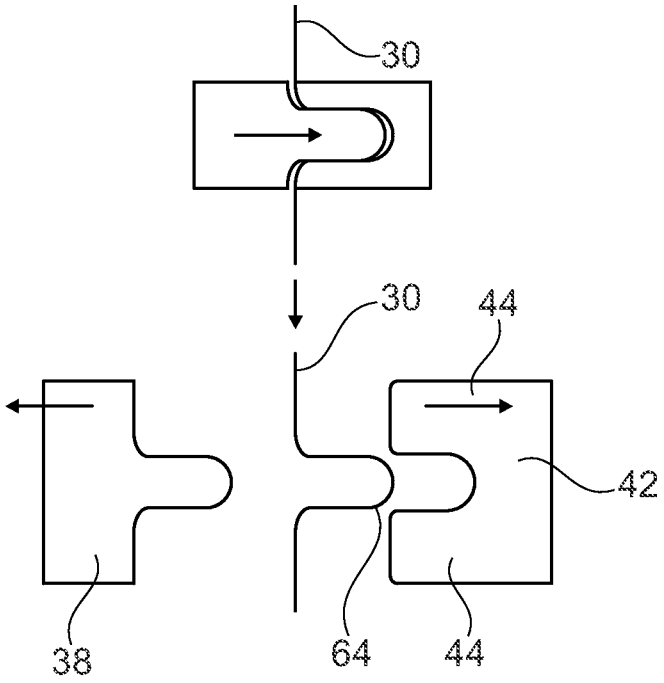
FIG. 2 shows the counter-bracket used in the apparatus according to the invention along with the bending part.

From the position shown in FIG. 1 the bending part 38 is moved in the direction of the bending jaw 42 in the direction of arrow so that the trunnion 40 grasps the wire in the region of its middle, i.e. with respect to the longitudinal extension, and presses the same between the counter-brackets 44, as shown in FIG. 2 at the top. As the trunnion 40 is configured complementary to the recess or to the gap 48, the shape of the bent or kinked portion of the wire 30 is produced very accurately (see FIG. 2). Subsequently, both the bending part 38 and the bending jaw 42 with the counter-brackets 44 is moved to the outside, as shown with the arrows in FIG. 2 at the bottom. The wire 30 then has a bending or kinking point in its middle.

After laterally moving the bending jaw 42, the same preferably is also moved into or out of the drawing plane in order to clear the way for a gripper 60 to be shifted laterally, which can be put into rotation by a motor and also is motorically movable along a guide 62. The guide 62 extends substantially perpendicularly to the longitudinal direction of the wire 30, always based on the condition of the wire in FIG. 1.

The gripper grasps the so-called eye 64, i.e. the kinking point or bending point at its tip and clamps the same.

Figure 3:
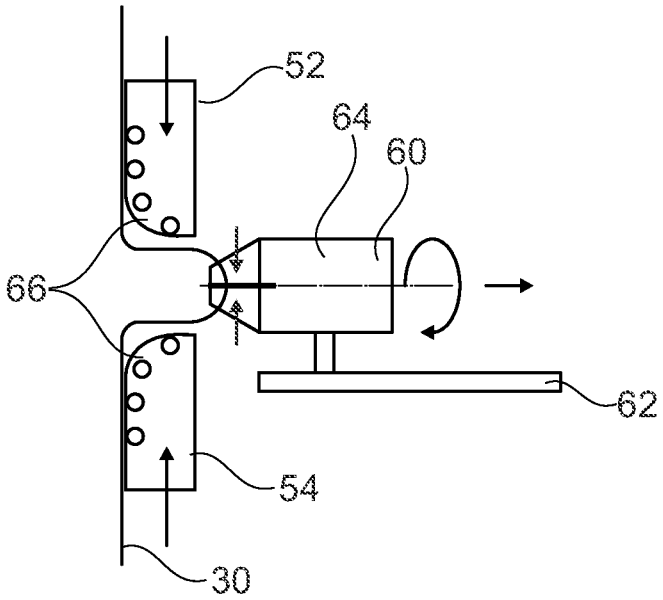
FIG. 3 shows the rotatable gripper when first grasping the kinked wire.

Before or after the grasping of the eye 64 by the gripper 60, the diverters 52, 54 are moved into their operative position as shown in FIG. 3. This operative position approximately corresponds to the operative position of the counter-bracket 44 in FIG. 1 and FIG. 2 at the top.

The diverters 52, 54 can however also be moved from the side, i.e. in the drawing plane or out of the drawing plane.

The diverters 52, 54 are formed with an arc-shaped bending surface 66 that acts as a sliding surface and along which the wire is drawn when the gripper 60 puts the eye 64 into rotation and at the same time pulls it to the right in the direction of arrow (see FIG. 3). Then, the linear wire portions of the two wire halves move along their arc-shaped bending surfaces 66 and are pulled into the space between the diverters 52, 54 and also bent in the process.

The arc-shaped bending surface thus extends over substantially 90°.

In addition, lateral limiters represented by rollers can be present here, which prevent the wire from slipping off the respective bending surface 66.

Figure 4:
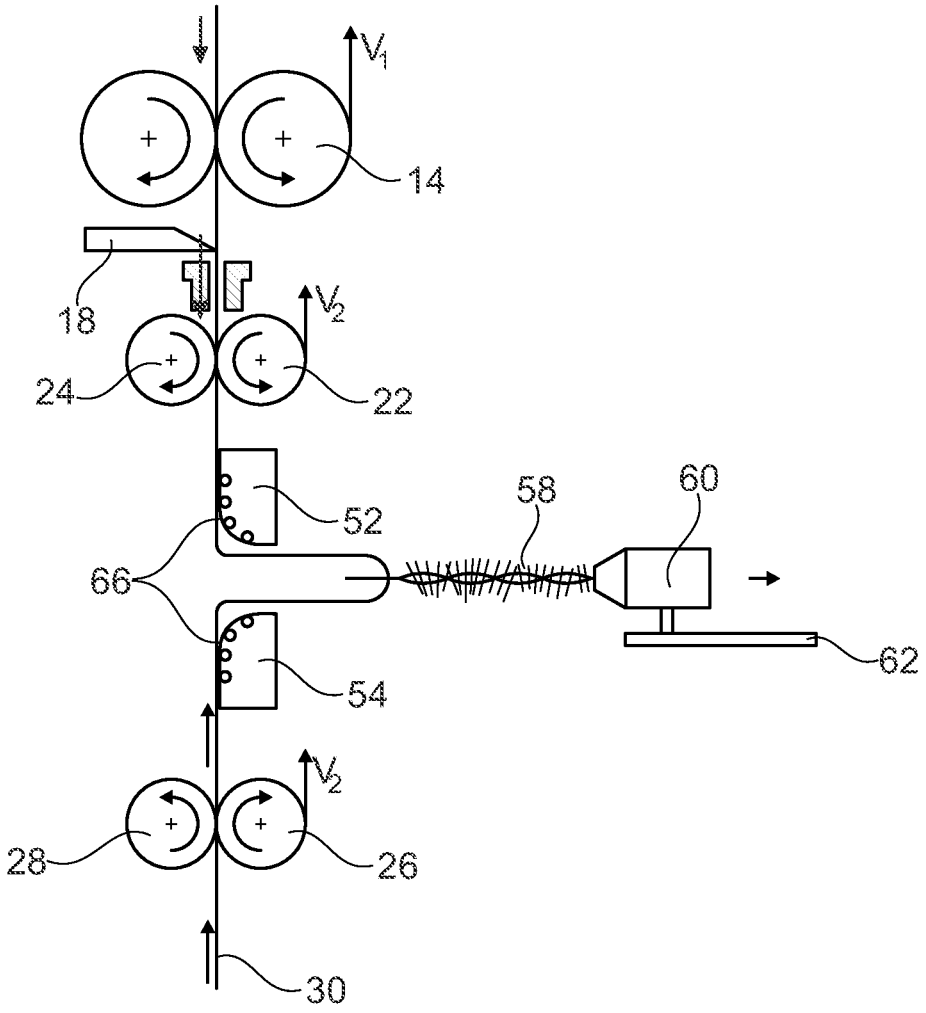
FIG. 4 shows a succeeding step in which the gripper already has twisted a part of the wire.

Subsequently, the wire is pulled further according to FIG. 4, at the same time it is twisted, and at the same time the bristles are introduced between the wire halves and clamped there on twisting.

During the twisting operation the drive rollers 22, 26 are put into movement, wherein they press wire material from the two non-bent ends of the wire halves towards each other in the direction of the diverters 52, 54 and hence towards the gripper 60 pulling the wire. This is necessary, because the propulsive force of the gripper for withdrawing wire is too small to overcome the friction of the wire at the bending surfaces 66 themselves.

The drive of the gripper 60 for rotating in particular is torque-controlled; it can be achieved by a servo motor. In addition, preferably all driven drive rollers likewise employ servo motors, which can be adjusted very well in terms of their speed.

When retracting the wire in FIG. 1, care moreover is taken that the circumferential speed of the drive rollers 22, 26 is the same as the circumferential speed of the auxiliary drive roller 14, so as not to cause any upsetting or pulling of the wire 30.

The diverters 52, 54 are of very simple design, they contain hardened surfaces, hence are to be manufactured from steel very easily and above all are very robust.

This also applies for the bending part and the bending jaws. These parts likewise are very easy to manufacture, above all they also are very easy to adapt to the desired optimum shape. Not every wire must have an identically formed eye, it rather is expedient to optimally design this eye depending on the wire thickness, etc. This adaptation is effected by optimally designed trunnions 40 and counter-brackets 44 including gap 48.

Figure 5:
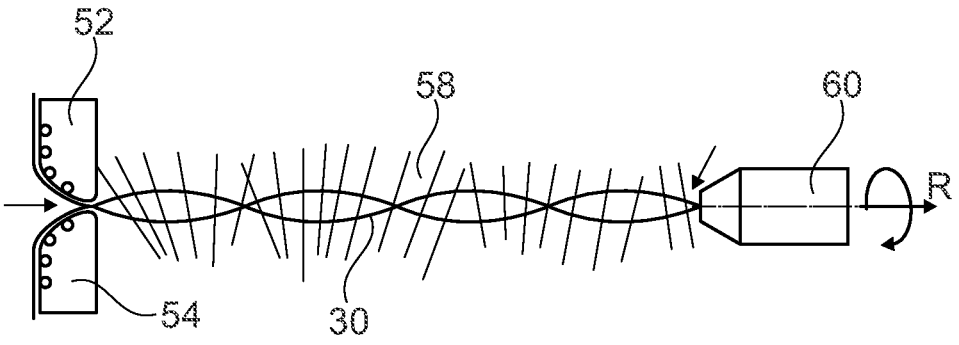
FIG. 5 shows a succeeding step in the apparatus according to the invention, in which the round brush is rotated almost completely.

FIG. 5 shows the end of the twisting process. Up to the end, the drive rollers 22, 26 have pressed the wire in the direction of the gripper 60 until the wire gets out of engagement with the same.

The special feature of the apparatus also is that twisting with the gripper 60 is not effected until reaching the final twisted condition of the round brush. Rather, a very slightly twisted spiral is produced, which is re-twisted in order to achieve the necessary and desired rotation of the wire halves and produce the proper tension. It is just sufficient that the bristles do not fall out of the twisted wire before the round brush is reworked.

The apparatus optionally can be equipped with a finishing station in which the bristles for example are cut (see FIG. 7), where a milling cutter or a knife 70 is moved along the almost finished brush, while the same is rotated. Moreover, an additional twisting can be effected in the finishing station, which bears the reference numeral 72, as indicated already.

Figure 6:
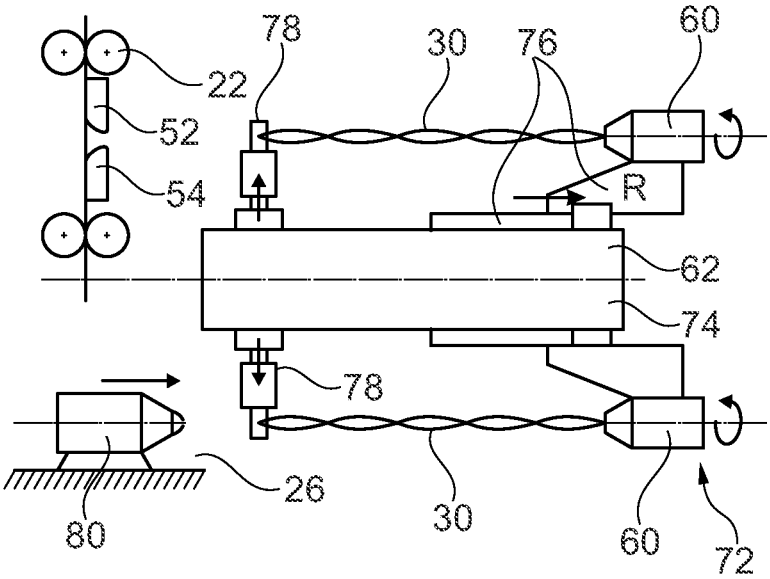
FIG. 6 shows the apparatus according to the invention, which in this embodiment is configured with a finishing station.
Figure 7:
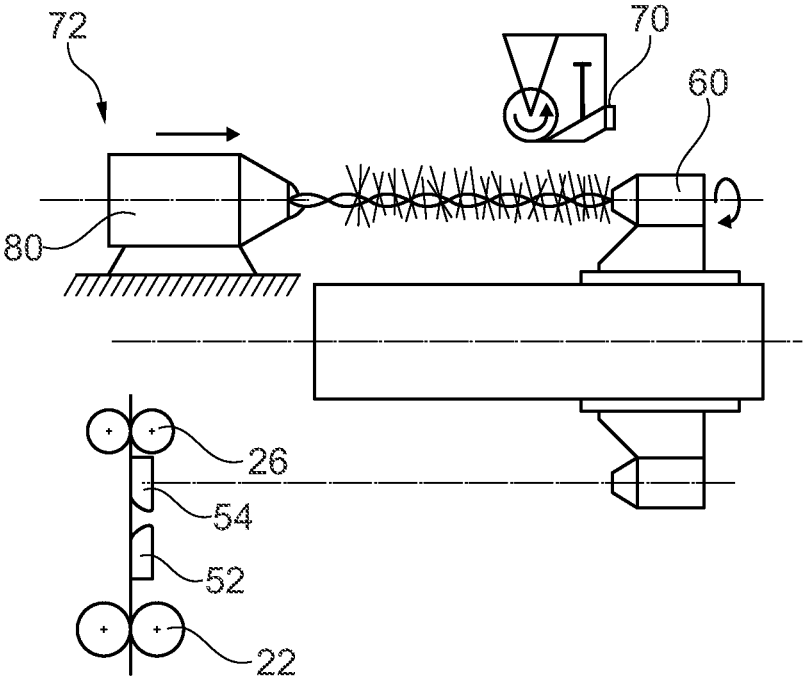
FIG. 7 shows another variant of the apparatus according to the invention, in which the finishing station is configured with a milling cutter or counter-knife for processing the bristles.

To prevent that the wire twisted already must be newly grasped, the apparatus has a rotatable guide, for example a drum on which the gripper 60 is movable. There is shown a base 76 that is moved on the guide 74. Along the base 76, the gripper 60 then is moved in longitudinal direction. On the guide 74 a plurality of rotatable grippers 60 are seated, which can be clocked in and out into various stations. The upper station in FIG. 6 is the feed station, which has just been explained with regard to FIG. 1. An intermediate holder 78 holds the free end of the twisted wire when the same is pulled out of the diverters 52,54. Subsequently, the apparatus is rotated, i.e. the guide 74 or the base 76 itself is rotated so that the rotatable gripper 60 gets into a finishing station 72 along with the intermediate holder 78 and the wire 30. Here, a stationary gripper 80 is seated, which grasps the free ends of the wire 30. The gripper 80 can be shifted in linear direction, as is shown in FIGS. 6 and 7. When the gripper 80 has grasped the free ends, the gripper 60 can rotate again so that twisting is possible. Of course, the gripper 80 might also rotate, which even is expedient for finishing by cutting.

While the brush is completed in the finishing station 72, the next brush already is manufactured in the feed station.

The invention claimed is:

1. An apparatus for manufacturing round brushes that include bristles clamped between two wire portions of a folded wire, comprising motor-driven drive rollers that move the wire in a longitudinal direction, a bending part movable transversely to the wire, opposed counter-brackets that are spaced apart from each other and that are arranged on a side of the wire opposite to the bending part, wherein the bending part can be shifted between the counter-brackets, which process bends the wire between itself and the counter-brackets to obtain bent wire with a V-shape or U-shape in order to form wire halves, a bristle feeding device for feeding bristles to the bent wire, and a rotating gripper that can grasp the bent wire and twist the same during the feeding of bristles in order to anchor the bristles in the wire, wherein diverters spaced apart from each other are provided for abutment of the wire, along which the wire halves are guided, wherein the diverters form a transition from non-bent wire portions of the wire halves to wire portions leading to the rotating gripper transversely to a longitudinal direction, and wherein the counter-brackets and the diverters are different parts that can be brought into contact with the wire and out of contact with the wire, wherein the counter-brackets are distanced from the bent wire during twisting.

2. The apparatus according to claim 1, wherein the counter-brackets and/or the diverters are traversable such that they can be brought into contact and out of contact with the wire in order to form a bending surface for the wire, along which the wire is moved and bent.

3. The apparatus according to claim 1, wherein the diverters are adjustable in the longitudinal direction of non-bent wire and/or transversely to the longitudinal direction.

4. The apparatus according to claim 1, wherein the counter-brackets are adjustable in the longitudinal direction of the non-bent wire and/or transversely to the longitudinal direction.

5. The apparatus according to claim 1, wherein the counter-brackets and the diverters substantially have the same operative position when the wire is in contact with them and alternately are movable into the operative position.

6. The apparatus according to claim 1, wherein the counter-brackets and the diverters, at least when they are in their operative position in which the wire contacts the counter-brackets and the diverters, are arranged between the motor-driven driven rollers.

7. The apparatus according to claim 1, wherein each driven drive roller forms a pair of drive rollers with a counter-roller, which transports the wire therebetween.

8. The apparatus according to claim 1, wherein at least one motor-driven auxiliary drive roller is provided, which transports the wire from a supply to the drive rollers.

9. The apparatus according to claim 1, wherein the counter-brackets are protruding, juxtaposed portions of an integral bending jaw.

10. The apparatus according to claim 9, wherein between the counter-brackets is a gap having a shape, and the bending part in its outer shape is adapted to the shape of the gap between the counter-brackets-and is formed complementarily.

11. The apparatus according to claim 1, wherein the diverters are configured as chicanes with an arc-shaped bending surface for the wire.

12. The apparatus according to claim 1, wherein the drive rollers are actuated such that during the twisting of the wire by the gripper they urge wire portions towards each other and in the direction of the gripper.

13. The apparatus according to claim 1, wherein a finishing station is provided, into which the twisted wire can be inserted and which further twists the wire and/or cuts the bristles on the outside.

14. The apparatus according to claim 13, wherein the finishing station has a stationary gripper that can grasp free ends of the wire halves, wherein the apparatus has a rotatable base to which a plurality of rotatable grippers are attached, wherein by rotating the base a rotatable gripper together with the wire just twisted can be transferred from a feed station, in which the counter-brackets and the drive rollers are seated, into the finishing station where the wire just twisted can be grasped by the stationary gripper, wherein the rotating gripper can be put into rotation for further twisting.

* * * * *